US008920637B2

(12) United States Patent
Massetti et al.

(10) Patent No.: US 8,920,637 B2
(45) Date of Patent: Dec. 30, 2014

(54) PROCESS FOR THE RECOVERY OF OILS FROM A SOLID MATRIX

(75) Inventors: Felicia Massetti, Capalbio Scalo (IT); Alessandro Nardella, Rome (IT)

(73) Assignee: ENI S.p.A., Rome (IT)

( * ) Notice: Subject to any disclaimer, the term of this patent is extended or adjusted under 35 U.S.C. 154(b) by 192 days.

(21) Appl. No.: 13/578,275

(22) PCT Filed: Feb. 8, 2011

(86) PCT No.: PCT/IB2011/000220
§ 371 (c)(1),
(2), (4) Date: Oct. 10, 2012

(87) PCT Pub. No.: WO2011/098889
PCT Pub. Date: Aug. 18, 2011

(65) Prior Publication Data
US 2013/0037449 A1 Feb. 14, 2013

(30) Foreign Application Priority Data
Feb. 12, 2010 (IT) ..... MI2010A0215

(51) Int. Cl.
*C10G 1/04* (2006.01)
*C10G 1/00* (2006.01)

(52) U.S. Cl.
CPC *C10G 1/04* (2013.01); *C10G 1/006* (2013.01); *C10G 2300/4006* (2013.01); *C10G 2300/4012* (2013.01); *C10G 2300/44* (2013.01); *C10G 2300/805* (2013.01)
USPC ..... 208/390; 210/633

(58) Field of Classification Search
USPC ..... 208/390
See application file for complete search history.

(56) References Cited

U.S. PATENT DOCUMENTS

| | | | | |
|---|---|---|---|---|
| 2,453,543 | A | 11/1948 | Schabelitz | |
| 3,334,043 | A | 8/1967 | Ferris et al. | |
| 4,036,732 | A * | 7/1977 | Irani et al. | 208/390 |
| 4,441,984 | A | 4/1984 | Guerre | |
| 4,929,341 | A * | 5/1990 | Thirumalachar et al. | 208/390 |
| 4,968,413 | A * | 11/1990 | Datta et al. | 208/390 |
| 5,571,403 | A | 11/1996 | Scott et al. | |
| 5,876,592 | A * | 3/1999 | Tipman et al. | 208/390 |
| 6,007,709 | A | 12/1999 | Duyvesteyn et al. | |
| 2006/0113218 | A1 | 6/2006 | Hart et al. | |
| 2010/0173806 | A1 * | 7/2010 | Fan et al. | 507/266 |

FOREIGN PATENT DOCUMENTS

| | | |
|---|---|---|
| CA | 2 521 248 | 3/2007 |
| WO | 92 22620 | 12/1992 |
| WO | 99 33936 | 7/1999 |
| WO | 2006 057688 | 6/2006 |

* cited by examiner

*Primary Examiner* — Brian McCaig
(74) *Attorney, Agent, or Firm* — Oblon, Spivak, McClelland, Maier & Neustadt, L.L.P.

(57) ABSTRACT

Process for the recovery of oils from a solid matrix comprising: subjecting said solid matrix to extraction by mixing with at least one organic solvent having a boiling point lower than or equal to 160° C., preferably ranging from 60° C. to 140° C., operating at a temperature ranging from 5° C. to 40° C., preferably ranging from 15° C. to 30° C., and at atmospheric pressure (1 atm), obtaining a solid-liquid mixture; subjecting said solid-liquid mixture to separation, obtaining a liquid phase comprising said oils and said organic solvent and a solid phase comprising said solid matrix; recovering said organic solvent from said liquid phase.

23 Claims, 4 Drawing Sheets

PROCESS FOR THE RECOVERY OF OILS FROM A SOLID MATRIX

Figure 1:
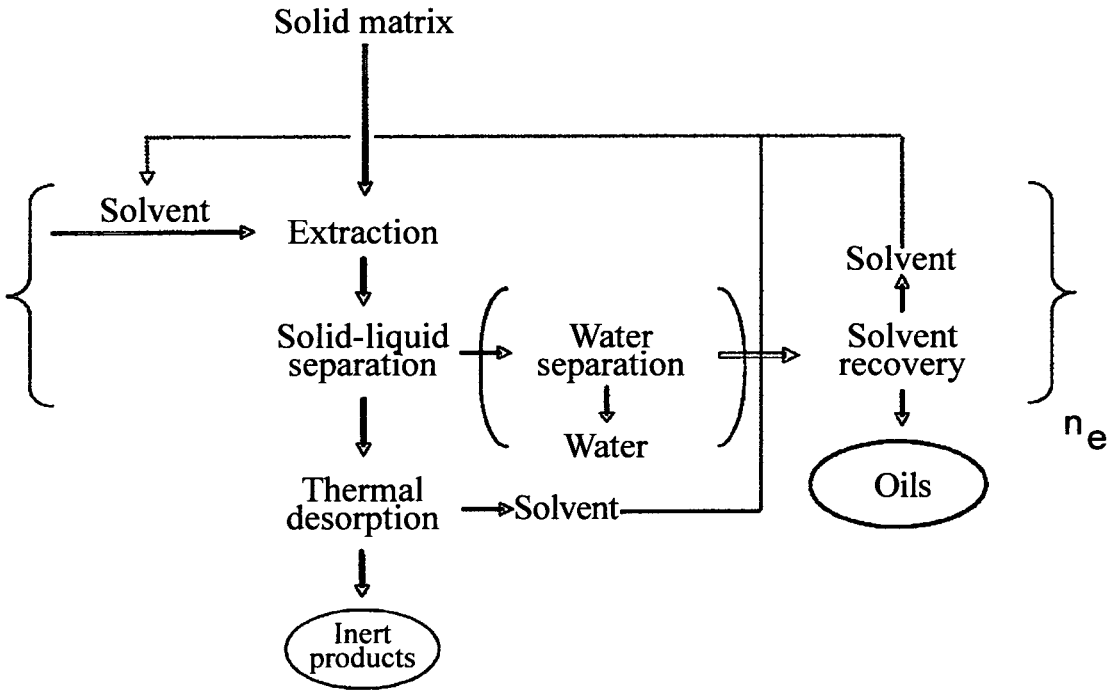

This application is a 371 of PCT/IB11/00220, filed Feb. 8, 2011. Priority to Italian patent application MI2010A 000215, filed Feb. 12, 2010, is claimed.

The present invention relates to a process for the recovery of oils from a solid matrix.

More specifically, the present invention relates to a process for the recovery of oils from a solid matrix by means of extraction with at least one organic solvent having a boiling point lower than 160° C.

Said solid matrix is preferably selected from oil sands, oil rocks, oil shales. Said solid matrix can even more preferably be selected from oil sands.

It is known that many hydrocarbon reserves currently available are represented by oil sands, oil rocks, oil shales, containing the so-called non-conventional oils, i.e. extra heavy oils or tars. Said non-conventional oils have an extremely high density (lower than 10° API) and a very high viscosity (higher than 10,000 cps) and, consequently, do not flow spontaneously under the reservoir conditions.

Their exploitation is therefore linked to intrinsically high costs for the mining and production set-up of the reservoirs which must be assisted by the application of costly technologies.

Mining and production set-up technologies of these reservoirs and for the extraction of said non-conventional oils are known in the art.

Said non-conventional oils can be extracted, for example, by strip mining, a process which requires the use of excavation and transport machinery which allow mining on different quarry faces. In this case, the mining is carried out by the recession of a single step (or quarry face), or stripping by descending horizontal sections. Strip mining is also used for reservoirs situated at a few tens of meters of depth.

The material obtained by strip mining is normally subjected to grinding in order to break the physico-chemical bonds between its constituents and to limit the cohesion between them, and, at the same time, to increase the overall effective surface, meaning the surface of said material which will be subsequently exposed to the action of the extraction solvent. In this way, the stony rock (e.g., quartz sandstone with slightly cemented bitumen) becomes loose rock, or "earth". This grinding is normally carried out at a temperature (generally lower than or equal to 150° C.) which does not cause aggregation phenomena of the bituminous substance present in said material, and allows particles (i.e. tailings) to be obtained, having the particle size of sand (<2 mm).

Hot water is added to the particles thus obtained, together with optional chemical additives in order to form a "slurry", which is subsequently fed to an oils extraction plant, where it is subjected to stirring. The combined action of hot water and stirring, causes the adhesion of small air bubbles to the oils, forming a bitumen froth which rises to the surface and can be recovered. The remaining part can be further treated to remove the residual water and the oil sand.

The oils thus extracted, which are heavier than conventional oils, can be subsequently mixed with lighter oil (liquid or gas), or they can be chemically separated and subsequently upgraded for producing synthetic crude oil.

The above process is extremely widespread and diversified and is normally applied to the oil sands of Western Canada, where they emerge or can be found at a few tens of meters of depth. In these contexts, the production of a barrel of oil requires the treatment of about two tons of oil sand, with a recovery yield of the oils from the formation equal to about 75%, said yield being calculated with respect to the total quantity of the oils present in said formation. The tailings, or particles already treated, which contain a hydrocarbon fraction which has not been removed, can be further treated until a recovery yield of said oils equal to about 90% has been reached.

The above process, however, cannot be used in the case of reservoirs situated at greater depths. In this case, in situ technologies are generally applied, which are mainly aimed at reducing the oil viscosity in the reservoir, situated at a depth ranging from a few tens to thousands of meters, by the introduction of vapour, solvents and/or hot air.

The extraction can be carried out, for example, by means of the cold flow process (Cold Heavy Oil Production with Sand—CHOPS) which allows the recovery of oils by pumping them directly from the sand reservoir. When the oils, even if extremely dense, are in any case able to flow, they are pumped using progressive cavity pumps.

Said process is commonly used in the reservoirs of Venezuela and Western Canada. Said process has the advantage of being economical but the disadvantage of allowing a low recovery yield of said oils, said yield being equal to about 5%-6% with respect to the total quantity of the oils present in the reservoir. By removing the filters which prevent the fine particles from flowing from the reservoir towards the surface, the production of sand associated with the oils increases considerably causing the formation of winding ducts in the subsoil and allowing an increase in the oil recovery factor (recovery yield equal to about 10% with respect to the total quantity of the oils present in the reservoir).

Another known in situ process is Cyclic Steam Stimulation (CSS). Said process, also known as "huff-and-puff", is based on the cyclic introduction of high-temperature (300° C.-400° C.) steam into the reservoir, for prolonged periods (from weeks to months), to allow the vapour to heat the mineralized formation and to fluidify the oils which can thus be recovered at the surface. Said process, widely used in Canada, can be repeated several times on the basis of technical and economic verifications. Although it allows a good recovery of the oils, with a recovery yield equal to about 20%-25% with respect to the total quantity of the oils present in the reservoir, said process is disadvantageous from an economical point of view as it has high running costs.

Another known in situ process is Steam Assisted Gravity Drainage (SAGD). The development of directed drilling techniques has allowed said process to be developed, which is based on the drilling of two or more horizontal wells at a few meters of distance in vertical with respect to each other and with an extension of kilometers with different azimuths. The steam is introduced into the upper well, the heat fluidifies the oil which accumulates by gravity in the lower well from which it is collected and pumped to the surface.

Said process, which can also be applied to the mineral mining of shallow reservoirs, is more economical with respect to the cyclic steam stimulation (CSS) process and leads to a good oil recovery yield, said yield being equal to about 60% with respect to the total quantity of the oils present in the reservoir.

Another known in situ process is the Vapour Extraction Process (VAPEX). Said process is similar to the Steam Assisted Gravity Drainage (SAGD) process, but hydrocarbon solvents are introduced into the reservoirs instead of steam, obtaining a better extraction efficiency and favouring a partial upgrading of the oils already inside the reservoir. The solvents are costly, however, and have a considerable impact on both the environment and safety of the work site (e.g., risks of fires and/or explosions).

A further known in situ process is Oil Sand Underground Mining (OSUM). Most of the tar oil reservoirs of Western Canada and almost all of those in Venezuela, are situated at such depths that the application of strip mining is not economical. This technique is sometimes also applied to reservoirs situated at depths lower than 50 m.

The above processes, however, can have various drawbacks. Said processes, for example, require the use of high quantities of water which is only partly recycled and must therefore be subjected to further treatments before being disposed of. In the case of Western Canada, for example, the volume of water necessary for producing a single barrel of synthetic crude oil—SCO, is equal to 2-4.5 times the volume of oil produced. Furthermore, these processes are generally characterized by a low extraction yield.

Attempts have been made in the art to overcome the above drawbacks.

European patent application EP 261,794, for example, describes a process for the recovery of heavy crude oil from tar sand which comprises treating said tar sand with an emulsion of a solvent in water characterized in that the emulsion contains from 0.5% to 15% by volume of solvent. Solvents which can be used for the purpose comprise hydrocarbons such as, for example, hexane, heptane, decane, dodecane, cyclohexane, toluene, and halogenated hydrocarbons such as, for example, carbon tetrachloride, dichloromethane.

American U.S. Pat. No. 4,424,112 describes a process and apparatus for the extraction with solvent of tar oils from oil sands and their separation into synthetic crude oil and synthetic fuel oil which comprises mixing the oil sands with hot water to form a slurry together with the solvent (e.g., toluene), subjecting said slurry to separation so as to obtain a phase comprising solvent and dissolved tar oils and a phase comprising solid material deriving from said oil sands, separating the tar oils from the solvent, putting the tar oils thus obtained in contact with an extraction agent (e.g., methyl butyl ketone) in order to separate the tar oils into synthetic crude oil and synthetic fuel oil, recovering and re-using the solvent, water and extraction agent in the process.

American U.S. Pat. No. 4,498,971 describes a process for the separate recovery of oils on the one hand and of asphaltenes and polar compounds on the other, from oil sands which comprises cooling the oil sands to a temperature ranging from −10° C. to −180° C. at which said sands behave like a solid material, grinding said solid material at said temperature to obtain relatively gross particles containing most of the sand and oil and relatively fine particles containing most of the asphaltenes and polar compounds, and mechanically separating the relatively gross particles from the relatively fine particles at said temperatures. Said relatively gross particles are subjected to extraction with a solvent (e.g., pentane, hexane, butane, propane) at a temperature ranging from about −30° C. to about −70° C., in order to recover the oil. Said relatively fine particles are subject to extraction with a solvent (e.g., pentane, hexane, butane, propane) at a temperature ranging from about −30° C. to about −70° C., in order to recover the asphaltenes and the polar compounds.

American U.S. Pat. No. 4,722,782 describes a process for the recovery of tar from oil sand which comprises putting the oil sand in contact with about 0.4 pounds to about 4 pounds of a hydrocarbon solvent (e.g., paraffins having from 4 to 9 carbon atoms, for example n-heptane) in order to form a slurry including solvent rich in tar and sand free of tar; adding over 0.5 pounds of water per pound of oil sand to the slurry, at a temperature ranging from about 100° F. to about 5° F. below the boiling point of the azeotropic mixture formed by the water and solvent, so as to form a mixture comprising solvent rich in tar, sand free of tar and water; introducing the mixture into a separator container; separating the solvent rich in tar from the mixture thus leaving water and a slurry comprising sand free of tar and residual quantities of solvent; stripping the residual solvent from the sand free of tar, and separating the tar from the solvent rich in tar.

The processes described above, however, also have various drawbacks such as, for example:

- the use of water which, also in this case, as only a small part of it is recycled, must be treated before disposal;
- a high energy consumption (e.g., heat);
- the high content of fine particles having a particle size lower than or equal to 65 μm present in the oils extracted which therefore require further purification treatments before being subjected to upgrading.

The Applicant has now found that the recovery of oils from a solid matrix can be advantageously carried out by subjecting said solid matrix to extraction in the presence of at least one organic solvent having a boiling point lower than or equal to 160° C., operating at a temperature lower than or equal to 40° C. and at atmospheric pressure (i.e. 1 atm).

Said process allows a good recovery yield of the oils to be obtained, i.e. an oil recovery yield higher than or equal to 60%, said yield being calculated with respect to the total quantity of the oils present in the solid matrix, operating at a temperature lower than or equal to 40° C. and at atmospheric pressure (i.e. 1 atm). Said process also allows a good recovery yield to be obtained, even operating with a limited energy requirement. Furthermore, said process allows a final solid residue to be obtained i.e. deoiled solid matrix, with characteristics which allow it to be replaced in situ without the necessity for further treatments. The solvent used, moreover, can be easily recovered and recycled to said process.

An object of the present invention therefore relates to a process for the recovery of oils from a solid matrix comprising:

- subjecting said solid matrix to extraction by mixing with at least one organic solvent having a boiling point lower than or equal to 160° C., preferably ranging from 60° C. to 140° C., operating at a temperature ranging from 5° C. to 40° C., preferably ranging from 15° C. to 30° C., and at atmospheric pressure (1 atm), obtaining a solid-liquid mixture;
- subjecting said solid-liquid mixture to separation obtaining a liquid phase comprising said oils and said organic solvent and a solid phase comprising said solid matrix;
- recovering said organic solvent from said liquid phase.

Before being subjected to extraction, said solid matrix can generally be subjected to grinding in order to obtain particles with reduced dimensions and which can therefore be easily treated in the above process.

In order to limit the quantity of solid matrix to be subjected to extraction with solvent, said solid matrix can be subjected to a pretreatment, i.e. to a grinding and to a densimetric separation.

A further object of the present invention therefore relates to a process for the recovery of oils from a solid matrix comprising:

- subjecting said solid matrix to grinding so as to obtain particles having a particle size lower than or equal to 5 mm, preferably ranging from 0.05 mm to 2 mm;
- subjecting said particles to densimetric separation, said densimetric separation comprising:
  - mixing said particles with water obtaining a first solid-liquid mixture;

subjecting said first solid-liquid mixture to separation obtaining a supernatant enriched in said oils and a sedimented residue impoverished in said oils;

subjecting said supernatant to extraction by mixing with at least one organic solvent having a boiling point lower than or equal to 160° C., preferably ranging from 60° C. to 140° C., operating at a temperature ranging from 5° C. to 40° C., preferably ranging from 15° C. to 30° C., and at atmospheric pressure (1 atm), obtaining a second solid-liquid mixture;

subjecting said second solid-liquid mixture to separation obtaining a liquid phase comprising said oils and said organic solvent and a solid phase comprising a residue of said solid matrix;

recovering said organic solvent from said liquid phase.

Said liquid phase can optionally comprise a residual quantity of said solid matrix (in particular, fine particles of said solid matrix).

Said solid phase can optionally comprise a residual quantity of said organic solvent.

According to a preferred embodiment of the present invention, said process can comprise, before subjecting said particles to densimetric separation, subjecting said particles to granulometric separation obtaining fractions of particles having a different particle size, said fractions of particles having a different particle size being subsequently subjected to said densimetric separation.

According to a preferred embodiment of the present invention, in said first solid-liquid mixture, the weight ratio between said particles or said fractions of particles and said water can range from 1:0.5 to 1:10, preferably ranging from 1:1 to 1:5.

In order to reduce the content of solid matrix in the extracted oils, in particular the content of fine particles, i.e. particles having a particle size lower than or equal to 65 μm, said particles or said fractions of particles, can be subjected to densimetric separation carried out in the presence of at least one deflocculating agent.

According to a preferred embodiment of the present invention, said first solid-liquid mixture can be obtained by mixing said particles or said fractions of particles with water and with at least one deflocculating agent.

Said deflocculating agent can preferably be present in such a quantity as to obtain a concentration of said deflocculating agent in said first solid-liquid mixture ranging from 0.8% by weight to 15% by weight, preferably ranging from 2% by weight to 10% by weight, with respect to the total weight of the water present in said first solid-liquid mixture.

According to a preferred embodiment of the present invention, said deflocculating agent can be selected from polyphosphates such as, for example, sodium hexametaphosphate, sodium pyrophosphate, calcium pyrophosphate, or mixtures thereof; hydroxides such as, for example, sodium hydroxide, potassium hydroxide, or mixtures thereof; carbonates such as, for example, sodium carbonate, potassium carbonate, or mixtures thereof; halogenated compounds such as, for example, sodium hypobromite, potassium hypobromite, or mixtures thereof; lignosulfonates such as, for example, sodium ligninsulfonate, potassium ligninsulfonate, magnesium ligninsulfonate, calcium ligninsulfonate, or mixtures thereof; or mixtures thereof. Sodium hexametaphosphate $(NaPO_3)_6$ is preferred.

In order to improve the separation and the recovery of said oils from said solid matrix, said particles or fractions of particles can be subjected to densimetric separation carried out in the presence of at least one organic solvent.

According to a preferred embodiment of the present invention, said first solid-liquid mixture can be obtained by mixing said particles or said fractions of particles with water and with at least one organic solvent having a boiling point lower than or equal to 160° C., preferably ranging from 60° C. to 140° C., obtaining said first solid-liquid mixture.

Said organic solvent can preferably be present in such a quantity as to obtain a weight ratio between said particles or said fractions of particles and said organic solvent ranging from 1:0.5 to 1:50, preferably ranging from 1:1 to 1:10. Said organic solvent can preferably be selected from the organic solvents used for the above extraction indicated below.

Said supernatant can optionally comprise a residual quantity of said solid matrix (in particular fine particles of said solid matrix).

Said sedimented residue can optionally comprise a residual quantity of said organic solvent.

It has to be noted that if said organic solvent forms a biphasic mixture with water, said supernatant enriched in said oils also comprises said organic solvent saturated with water.

It has to be noted that, in addition to said supernatant and said sedimented residue, an intermediate aqueous phase can be obtained from the separation of said first solid-liquid mixture. If said organic solvent forms a biphasic mixture with water, said intermediate aqueous phase is saturated with said organic solvent.

It has to be noted that said supernatant, before being subjected to extraction, can be optionally subjected to sedimentation obtaining an oily phase comprising a part of said oils which does not require further treatments and a solid phase comprising the remaining part of said oils and a residual quantity of said solid matrix (in particular, fine particles of said solid matrix), said solid phase being subsequently sent to said extraction with the organic solvent.

It has to be noted that said densimetric separation and said granulometric separation can be carried out after subjecting said solid matrix to extraction with the organic solvent.

For the purposes of the present description and of the following claims, the term "supernatant enriched in said oils", indicates that said supernatant comprises an amount of oils higher than or equal to 50% by weight, preferably ranging from 60% by weight to 99.9% by weight, with respect to the total amount of the oils present in said solid matrix.

For the purposes of the present description and of the following claims, the term "sedimented residue impoverished in said oils" indicates that said sedimented residue comprises an amount of oils lower than or equal to 50% by weight, preferably ranging from 0.1% by weight to 40% by weight, with respect to the total amount of the oils present in said solid matrix.

For the purposes of the present description and of the following claims, the term "oils" indicates both extra heavy oils and tars present in said solid matrix (i.e. the so-called non-conventional oils).

For the purposes of the present description and of the following claims, the definitions of the numerical ranges always comprise the extremes unless otherwise specified.

According to a preferred embodiment of the present invention, said solid matrix can be selected from oil sands, oil rocks, oil shales. Said solid matrix is preferably selected from oil sands.

Said solid matrix can optionally contain water, the so-called connate water. The quantity of said water generally increases with an increase in the presence of fine particles (e.g., particles having a particle size lower than or equal to 65 μm) and can reach saturation of said solid matrix.

Said mixing (i.e. the mixing of said solid matrix or of said supernatant with said organic solvent), as also the mixing of said particles or of said fractions of particles with water and optionally with said deflocculating agent and/or with said organic solvent, can be carried out in mixers known in the art, preferably in plough mixers.

According to a preferred embodiment of the present invention, said organic solvent can have a density, measured at 20° C. and at atmospheric pressure (1 atm), lower than or equal to 1.5 g/cm$^3$, preferably ranging from 0.5 g/cm$^3$ to 1 g/cm$^3$.

It has to be noted that, if said organic solvent is used in the densimetric separation of said particles or of said fractions of particles, it is preferable to use an organic solvent having a density, measured at 20° C. and at atmospheric pressure (1 atm), ranging from 0.5 g/cm$^3$ to 1 g/cm$^3$.

According to a preferred embodiment of the present invention, said organic solvent can be selected from:

- esters such as, for example, ethyl acetate, isopropyl acetate, n-butyl acetate, or mixtures thereof;
- ketones such as, for example, acetone, hexanone, cyclohexanone, or mixtures thereof;
- aliphatic hydrocarbons such as, for example, n-hexane, n-octane, nonane, decane, cyclohexane, or mixtures thereof;
- aromatic hydrocarbons such as, for example, toluene, isomers of xylene, benzene, or mixtures thereof;
- refinery cuts which comprise: (i) mixtures of said aliphatic hydrocarbons; (ii) mixtures of said aromatic hydrocarbons; (iii) mixtures of said aliphatic and aromatic hydrocarbons; or mixtures thereof;
- or mixtures thereof.

Said organic solvent can preferably be selected from ethyl acetate, n-hexane, cyclohexane, acetone, toluene, or mixtures thereof.

According to a preferred embodiment of the present invention, the weight ratio between said solid matrix or said supernatant and said organic solvent can range from 1:0.5 to 1:10, preferably from 1:1 to 1:5.

According to a preferred embodiment of the present invention, the mixing of said organic matrix or of said supernatant with said organic solvent can be carried out for a time ranging from 5 minutes to 60 minutes, preferably from 10 minutes to 30 minutes.

Said solid matrix or said supernatant can be subjected to extraction once or several times. Said solid matrix or said supernatant can preferably be subjected to extraction from one to ten times, more preferably from 2 times to 3 times.

According to a preferred embodiment of the present invention, the separation of said solid-liquid mixture can be carried out by centrifugation, cycloning, sedimentation, preferably by sedimentation.

According to a preferred embodiment of the present invention, the recovery of said organic solvent from said liquid phase can be carried out by distillation at a temperature ranging from 50° C. to 150° C., preferably from 60° C. to 90° C., and at a pressure ranging from 0.01 atm to 1 atm, preferably ranging from 0.1 atm to 0.8 atm.

The water optionally present in said solid matrix (i.e. connate water) and optionally present in the liquid phase obtained after separation of said solid-liquid mixture, can be separated from said liquid phase by sedimentation.

It has to be noted that if the above densimetric separation is carried out, said liquid phase can comprise part of the water used for obtaining said first solid-liquid mixture.

In order to favour the separation of the water optionally present in said liquid phase, at least one strong electrolyte, such as, for example, sodium chloride (NaCl), calcium chloride ($CaCl_2$), sodium sulphate ($Na_2SO_4$), or mixtures thereof, can be added to said liquid phase.

According to a preferred embodiment of the present invention, said strong electrolyte can be added to said liquid phase in a quantity ranging from 1% by weight with respect to the total weight of said liquid phase to the solubility limit of said electrolyte in said liquid phase, preferably from by weight with respect to the total weight of said liquid phase to 80% of the solubility limit of said electrolyte in said liquid phase.

Said oils can be sent to subsequent treatments such as, for example, upgrading treatments via hydrogenation or hydrocracking, in order to obtain hydrocarbon fractions having a higher commercial value.

In order to recover the residual quantity of solid matrix optionally present in said liquid phase, said liquid phase can optionally be subjected to filtration before being sent for recovery of the organic solvent.

In order to recover the residual quantity of organic solvent optionally present in said solid phase and/or in said sedimented residue, said solid phase and/or said sedimented residue can be subjected to low-temperature thermal desorption.

According to a preferred embodiment of the present invention, said solid phase and/or said sedimented residue can be subjected to thermal desorption, at a temperature ranging from 50° C. to 150° C., preferably ranging from 60° C. to 90° C. The solvent thus recovered can be recycled to the above process whereas the final solid residue (i.e. the deoiled solid matrix) recovered can be relocated in situ or re-used (for example, for road fills or beds) without the need for further treatments.

Alternatively, said solid phase and/or said sedimented residue can be relocated in situ or re-used (for example, for road fills or beds) without being subjected to thermal desorption.

Said grinding can be carried out with equipment known in the art such as, for example, hammer mills, knife mills, preferably hammer mills. Said grinding is preferably carried out at a temperature which does not cause the softening of the solid matrix.

Before being subjected to grinding, said solid matrix can be optionally cooled to below the glass transition temperature of the oils present in said solid matrix.

According to a preferred embodiment of the present invention, said densimetric separation can be carried out by means of flow tables, gravimetric coils, settlers, preferably settlers.

Even more preferably, the above densimetric separation can be carried out by means of a settler equipped with a bottom scraper from which a heavier phase (sedimented residue) substantially free of oil, a lighter phase (supernatant) enriched in oils which is subsequently sent to extraction with an organic solvent and, optionally, an intermediate aqueous phase which can be subsequently sent to a water treatment phase, can be extracted.

According to a preferred embodiment of the present invention, said densimetric separation can be carried out by means of vibrating screens, cyclones, preferably vibrating screens.

The present invention will now be illustrated by various embodiments with reference to FIGS. 1-4 provided hereunder.

FIG. 1 schematically represents an embodiment of the process, object of the present invention. The solid matrix (e.g., oil sand), is subjected to extraction with at least one organic solvent obtaining a solid-liquid mixture. Said solid-liquid mixture is subjected to separation obtaining a liquid phase comprising said oils and said organic solvent and a solid phase comprising said solid matrix. Said liquid phase is sent for the recovery of the solvent which is then recycled to the process (i.e. to the extraction with solvent) and said oils (i.e. the oils present in the solid matrix), which can be sent to subsequent upgrading treatments (not represented in FIG. 1). If said solid matrix comprises water, said liquid phase also comprises water: said water can be separated from said liquid phase by sedimentation (as represented, in brackets, in FIG. 1).

Said solid phase is subjected to low-temperature thermal desorption in order to recover the residual organic solvent which is subsequently recycled to the process (i.e. to the extraction with solvent) and a solid phase comprising said solid matrix (i.e. inert products).

As represented in FIG. 1, the solid matrix can be subjected to extraction with organic solvent ($n_e$) times, preferably from 1 to 10 times, more preferably from 2 to 3 times.

Figure 2:
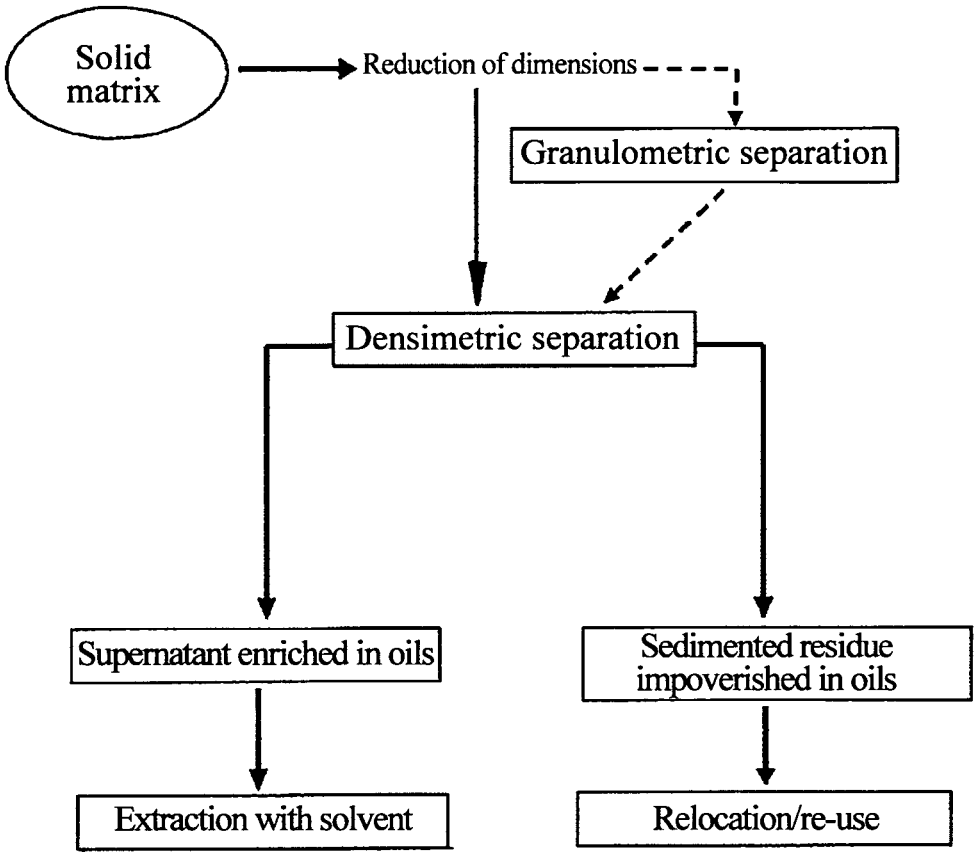

FIG. 2 represents a further embodiment of the process, object of the present invention. The solid matrix (e.g., oil sand) is subjected to a reduction in the dimensions (e.g., by grinding) in order to obtain particles having a particle size lower than or equal to 5 mm which can be subjected to:

- densimetric separation (e.g., by means of flow tables, gravimetric spirals, settlers); or
- granulometric separation (e.g., by means of vibrating screens, cyclones) (represented in FIG. 2 with a dashed line) and subsequent densimetric separation;

obtaining a supernatant enriched in oils which is subjected to extraction with an organic solvent and a sedimented residue impoverished in oils which can be relocated in situ or re-used.

Figure 3:
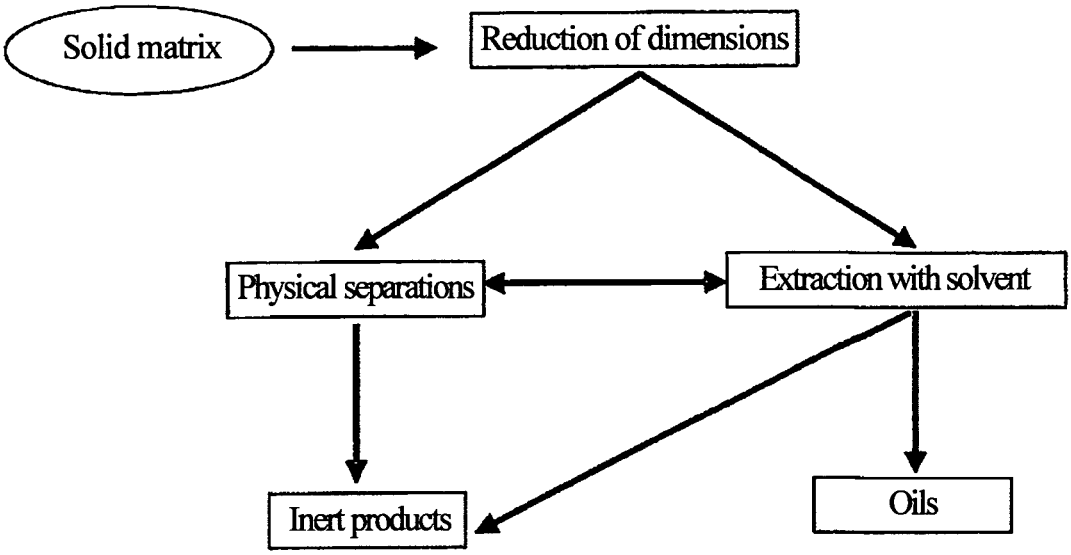

These physical separations (e.g., granulometric separation and densimetric separation) can be applied to both the solid matrix as such, and to the solid matrix after extraction with an organic solvent as represented in FIG. 3.

In FIG. 3, the solid matrix (e.g., oil sand) is subjected to a reduction in the dimensions (e.g., by grinding) in order to obtain particles having a particle size lower than or equal to 5 mm which can be:

- sent to extraction with an organic solvent (solid matrix as such); or
- subjected to the physical separations indicated in FIG. 2 and subsequent extraction with an organic solvent.

After extraction with an organic solvent, a liquid phase is obtained which can be sent for recovery of the solvent which is then recycled to the process (i.e. to the extraction with solvent) (not represented in FIG. 3) and said oils (i.e. the oils present in the solid matrix), which can be sent to subsequent upgrading treatments (not represented in FIG. 1) and a solid phase comprising said organic matrix (i.e. inert products).

Figure 4:
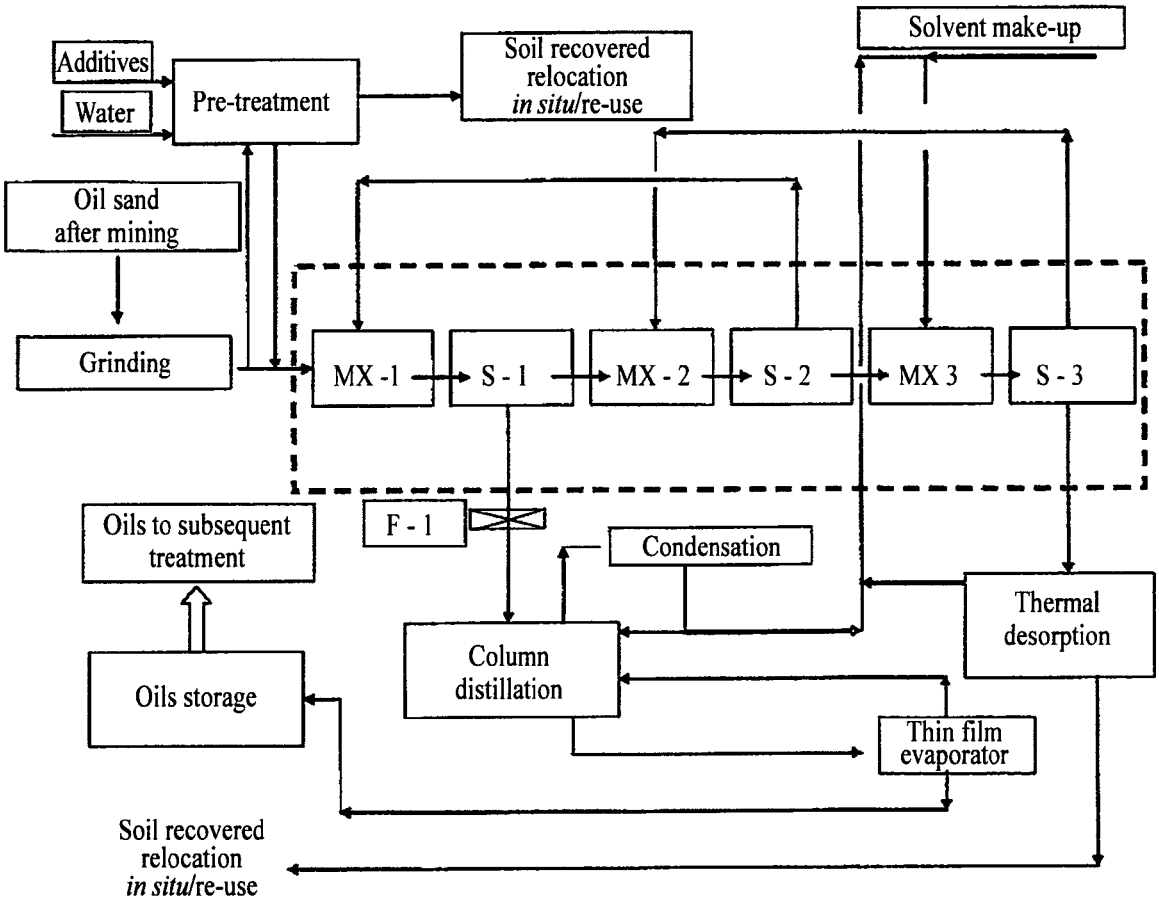

FIG. 4 represents a block scheme relating to a further embodiment of the process object of the present invention.

As represented in FIG. 4, after mining, the oil sand is fed to a grinding section in order to reduce the dimensions of said oil sand to a particle size of a few mm (lower than or equal to 5 mm, preferably ranging from 0.05 mm to 2 mm). The operation can be carried out with a mill (preferably a hammer mill). The oil sand rich in non-conventional oils (i.e. very heavy oils and tars) can be sent from the mill directly to the extraction section with an organic solvent, or it can be sent to a pretreatment section. Physical separation is carried out in this latter section, i.e. the densimetric separation or the optional granulometric separation followed by the densimetric separation, preferably with the help of deflocculating agents and/or of organic solvents as described above, in order to limit the quantity of oil sand to be subjected to solvent extraction.

The above densimetric separation can preferably be carried out by means of a settler equipped with a bottom scraper from which a heavier phase (sedimented residue) substantially free of oil, a lighter phase (supernatant) enriched in oils which is subsequently sent to extraction with solvent, and, optionally, an intermediate aqueous phase which can be subsequently sent to a water treatment phase, can be extracted.

The above granulometric separation can preferably be carried out with vibrating screens.

The oil sand after grinding, or the supernatant enriched in oils, is fed to the extraction section with an organic solvent (preferably, ethyl acetate) which provides various extraction/separation steps (preferably, 3 steps) in which the organic solvent and the material to be treated (i.e. oil sand or supernatant) move in countercurrent.

For the above purpose, the material to be treated, i.e. the oil sand or the supernatant, is fed to the first mixer (MX-1) (preferably, a plough mixer) where it is mixed with the organic solvent coming from the second settler (S-2), forming a solid-liquid mixture.

Said solid-liquid mixture is subsequently fed, by means of a volumetric pump (not represented in FIG. 4), to the first settler (S-1), where a liquid phase comprising oils and said organic solvent and a solid phase comprising oil sand (i.e. inert products) are separated by sedimentation.

Said liquid phase is accumulated in an intermediate tank (not represented in FIG. 4). Said liquid phase is sent by means of a centrifugal pump (not represented in FIG. 4) and, after filtration (F-1) to separate the residues of oil sand (i.e. inert products) optionally present, from said intermediate separator to a distillation column. The organic solvent substantially free of said oils, is obtained from the head of said distillation column, which, after condensation, is recycled to the plant, whereas the oils are obtained from the bottom of said distillation column, which are sent to a thin film evaporator, from which they are discharged and sent to subsequent treatments (e.g., upgrading).

As indicated above, in order to favour the separation of the water optionally present in said liquid phase, at least one strong electrolyte can be added to said liquid phase.

Said solid phase comprising oil sand soaked with organic solvent, is sent from the bottom of the first settler (S-1) to the second mixer (MX-2) (preferably, a plough mixer), where is it mixed with the solvent leaving the third settler (S-3) carrying out an extraction in countercurrent between said solid phase and the organic solvent.

Organic solvent is obtained from the second mixer (MX-2), after sedimentation in the second settler (S-2), which is recycled to the first mixer (MX-1), together with a further solid phase which is fed to the third mixer (MX-3) (preferably, a plough mixer), where is it mixed with organic solvent coming from the distillation column.

After sedimentation in the third settler (S-3), a further solid phase comprising oil sand (i.e. inert products) is obtained, which is sent to a low-temperature thermal desorption unit (65° C.-77° C.) from which the residual organic solvent is recovered and recycled and the final solid residue (i.e. the deoiled solid matrix) is discharged and can be relocated in situ or re-used.

Some illustrative and non-limiting examples are hereunder provided for a better understanding of the present invention.

EXAMPLE 1

A sample of 140 g of oil sand containing 13% by weight of oils, determined by weighing the extract obtained according to the method EPA 3540C, using methylene chloride as extraction solvent, was ground by means of a hammer mill, reduced to a particle size of less than 1 mm and divided into two aliquots of 70 g. These aliquots were introduced into two 300 ml steel test-tubes and were subjected to solvent extraction.

For the above purpose, ethyl acetate was added to one sample, in a solid:liquid weight ratio equal to 1:1, whereas toluene was added to the other sample in a solid:liquid weight ratio equal to 1:1.

The samples were left, at room temperature (25° C.) and at atmospheric pressure (1 atm), under stirring, for 30 minutes, obtaining a solid-liquid mixture. Said solid-liquid mixture was subsequently subjected to separation by sedimentation obtaining a liquid phase comprising the oils and the solvent and a solid phase comprising the oil sand (i.e. inert products).

The solvent extraction was repeated for a further two times using fresh solvent each time.

The recovery of the solvent from said liquid phase was carried out by distillation at 70° C. and at a pressure equal to 0.8 atm, whereas the recovery of the solvent from the solid phase was carried out by thermal desorption at 80° C.

At the end of the three extraction steps, the recovery yield of the oils in the sample treated with toluene was equal to 100% with respect to the total quantity of the oils present in the initial sample whereas, in the sample treated with ethyl acetate, the recovery yield of the oils was equal to 65% with respect to the total quantity of the oils present in the initial sample.

EXAMPLE 2

A sample of 100 g of oil sand containing 13% by weight of oils (determined according to the method EPA 3540C as described above), was ground by means of a hammer mill and reduced to a particle size of less than 4 mm. It was then sieved on sieves with a mesh equal to 4 mm, 1 mm and 0.250 mm.

The various granulometric fractions were subsequently mixed with water in a ratio of 1:1 obtaining a solid-liquid mixture which was left to settle, obtaining for each fraction a supernatant enriched in oils and a sedimented residue impoverished in oils. Table 1 indicates the data relating to the supernatant and to the sedimented residue (i.e. sediment).

TABLE 1

| Granulometric fraction (mm) | Phase | A (%) | B (%) | C (%) | D (%) |
|---|---|---|---|---|---|
| 4-1 | Supernatant | 14 | 12 | 16 | 15 |
| | Sediment | | 3 | 15 | 4 |
| 1-0.250 | Supernatant | 64 | 22 | 27 | 51 |
| | Sediment | | 41 | 5 | 16 |
| <0.250 | Supernatant | 22 | 7 | 17 | 10 |
| | Sediment | | 15 | 3 | 4 |

A: granulometric distribution;
B: densimetric distribution;
C: concentration of oils (determined according to the method EPA 3540C as described above);
D: distribution of oils (this is calculated by considering the oils at the inlet as 100 and calculating how they are distributed into the different granulometric fractions and the different phases).

From the data indicated in Table 1, it can be deduced that from the appropriate combination of simple physical separation processes, it was possible to isolate from the initial sample, a fraction of particles equal to 22% by weight with respect to the total weight of the initial sample, comprising more than 50% of the oils present in the initial sample.

A fraction of particles equal to 15% by weight with respect to the total weight of the initial sample, is also obtained, having a concentration of oils equal to 3% by weight corresponding to 4% of the oils present in the initial sample.

EXAMPLE 3

A sample of 100 g of oil sand containing 6.7% by weight of oils (determined according to the method EPA 3540C as described above), was ground by means of a hammer mill and reduced to a particle size of less than 1 mm. It was then sieved on sieves with a mesh ranging from 1,000 μm to 50 μm, obtaining the granulometric distribution indicated in Table 2. Table 2 also indicates the concentration of oils and the distribution of said oils in each granulometric fraction.

TABLE 2

| Granulometric fraction (μm) | A (%) | C (%) | D (%) |
|---|---|---|---|
| 1000-500 | 7.8 | 10.5 | 12.3 |
| 500-250 | 51.7 | 5.7 | 43.9 |
| 250-125 | 34.2 | 5.7 | 29.2 |
| 125-50 | 5.2 | 14.3 | 11.1 |
| <50 | 1.1 | 22.2 | 3.6 |

A: granulometric distribution;
C: concentration of oils (determined according to the method EPA 3540C as described above);
D: distribution of oils (this is calculated by considering the oils at the inlet as 100 and calculating how they are distributed into the various granulometric fractions and different phases).

The granulometric fractions ranging from 500 μm to 125 μm, equal to 86% by weight with respect to the total weight of the initial sample, containing 73% of the oils present in the initial sample, were joined and the resulting sample was mixed with water in a solid:water weight ratio equal to 1:1 and left to settle, obtaining a supernatant enriched in oils, a sedimented residue impoverished in oils, and an intermediate aqueous phase. Table 3 indicates the data relating to the supernatant and sedimented residue (i.e. sediment).

TABLE 3

| Granulometric fraction (μm) | Phase | B (%) | B' (%) | C (%) | D (%) | E (%) |
|---|---|---|---|---|---|---|
| 500-125 | Supernatant | 62.1 | 53.4 | 6.4 | 87.06 | 63.6 |
| | Sediment | 37.9 | 32.6 | 1.6 | 12.94 | 9.5 |

B: densimetric distribution;
B': densimetric distribution (weight % with respect to the feed);
C: concentration of oils (determined according to the method EPA 3540C as described above);
D: distribution of oils (this is calculated by considering the oils at the inlet as 100 and calculating how they are distributed into the various granulometric fractions and different phases);
E: distribution of oils (weight % with respect to the feed).

From Tables 2 and 3 it can be deduced that, starting from a feed consisting of oil sands with an average oil content equal to 6.7% by weight, it is possible to isolate a granulometric fraction equal to 32.6% by weight with respect to the weight of the initial sample, comprising 1.6% by weight of oils which does not require further treatments. In this way, it is possible to feed only ⅔ of the total mass of oil sand to the solvent extraction.

EXAMPLE 4

A sample of 60 g of oil sand containing 10.8% by weight of oils (determined according to the method EPA 3540C as described above), was ground by means of a hammer mill and reduced to a particle size of less than 1 mm and divided into 6 equal aliquots.

A first aliquot (sample 1) was mixed, for 10 minutes, with a biphasic solution containing 2 g of ethyl acetate and 8 g of an aqueous solution of sodium hexametaphosphate at 8% by weight obtaining, by sedimentation, a supernatant comprising ethyl acetate saturated with water and enriched in oils, a sedimented residue impoverished in oils, and an intermediate aqueous phase saturated with ethyl acetate. Table 4 indicates the data relating to the supernatant and to the sedimented residue (i.e. sediment).

A second aliquot (sample 2) was mixed, for 10 minutes, with a biphasic solution containing 10 g of ethyl acetate and 10 g of an aqueous solution of sodium hexametaphosphate at 8% by weight obtaining, by sedimentation, a supernatant comprising ethyl acetate saturated with water and enriched in oils, a sedimented residue impoverished in oils, and an intermediate aqueous phase saturated with ethyl acetate. Table 4 indicates the data relating to the supernatant and to the sedimented residue (i.e. sediment).

A third aliquot (sample 3) was mixed, for 10 minutes, with a biphasic solution containing 10 g of n-hexane and 10 g of an aqueous solution of sodium hexametaphosphate at 8% by weight obtaining, by sedimentation, a supernatant comprising n-hexane saturated with water and enriched in oils, a sedimented residue impoverished in oils, and an intermediate aqueous phase saturated with n-hexane. Table 4 indicates the data relating to the supernatant and to the sedimented residue (i.e. sediment).

A fourth aliquot (sample 4) was mixed, for 10 minutes, with a solution containing 10 g of acetone and 10 g of an aqueous solution of sodium hexametaphosphate at 8% by weight obtaining, by sedimentation, a supernatant enriched in oils and a sedimented residue impoverished in oils. Table 4 indicates the data relating to the supernatant and to the sedimented residue (i.e. sediment).

A fifth aliquot (sample 5) was mixed, for 10 minutes, with a solution containing 5 g of acetone, 5 g of ethyl acetate and 10 g of an aqueous solution of sodium hexametaphosphate at 8% by weight obtaining, by sedimentation, a supernatant enriched in oils and a sedimented residue impoverished in oils. Table 4 indicates the data relating to the supernatant and to the sedimented residue (i.e. sediment).

A sixth aliquot (sample 6) was mixed, for 10 minutes, with a biphasic solution containing 10 g of toluene and 10 g of an aqueous solution of sodium hexametaphosphate at 8% by weight obtaining, by sedimentation, a supernatant comprising toluene saturated with water and enriched in oils, a sedimented residue impoverished in oils, and an intermediate aqueous phase saturated with toluene. Table 4 indicates the data relating to the supernatant and to the sedimented residue (i.e. sediment).

TABLE 4

| Sample | Phase | B (%) | C (%) | D (%) | E (%) |
|---|---|---|---|---|---|
| 1 | Supernatant | 69.7 | 15.0 | 10.47 | 96.6 |
| | Sediment | 30.3 | 1.2 | 0.37 | 3.4 |
| 2 | Supernatant | 27.5 | 38.7 | 10.63 | 98.1 |
| | Sediment | 72.5 | 0.3 | 0.21 | 1.9 |
| 3 | Supernatant | 35.1 | 29.9 | 10.50 | 96.9 |
| | Sediment | 64.9 | 0.5 | 0.34 | 3.1 |
| 4 | Supernatant | 41.5 | 25.2 | 10.46 | 96.6 |
| | Sediment | 58.5 | 0.6 | 0.37 | 3.4 |
| 5 | Supernatant | 22.9 | 45.6 | 10.43 | 96.2 |
| | Sediment | 77.1 | 0.5 | 0.41 | 3.8 |
| 6 | Supernatant | 25.0 | 42.6 | 10.67 | 98.5 |
| | Sediment | 75.0 | 0.2 | 0.17 | 1.5 |

B: densimetric distribution;
C: concentration of oils (determined according to the method EPA 3540C as described above);
D: distribution of oils (this is calculated by considering the oils at the inlet as 100 and calculating how they are distributed into the different granulometric fractions and the different phases);
E: distribution of oils (weight % with respect to the feed).

From the data indicated in Table 4, it can be deduced that by subjecting the samples of oil sand to densimetric separation after grinding, operating in the presence of water, of an organic solvent or a mixture of organic solvents and of a deflocculating agent, according to the present invention, a sedimented residue impoverished in oils is obtained (containing from 0.2% by weight to 1.2% by weight of oils) which does not require further treatments, together with a supernatant enriched in oils to be sent to subsequent extraction with a solvent. Also in this case, it is possible to feed only a fraction of the total mass of oil sands to the solvent extraction.

EXAMPLE 5

A sample of 100 g of oil sand containing 11.2% by weight of oils (determined according to the method EPA 3540C as described above), was ground by means of a hammer mill, reduced to a particle size of less than 1 mm and subsequently treated as the sample 2 of Example 4.

79.7 g of a sedimented residue impoverished in oils (containing 0.08% by weight of oils), which does not require further treatments, 20.3 g of a supernatant comprising ethyl acetate saturated with water and enriched in oils, a sedimented residue impoverished in oils, and an intermediate aqueous phase saturated with ethyl acetate, were separated by sedimentation.

Said supernatant was left to settle obtaining an oily phase comprising about 5 g of oils equal to 45% of the oils present in the initial sample and a sedimented phase.

Said sedimented phase, comprising oil sand (i.e. inert products) and oils in an approximately equiweight ratio, is again subjected to densimetric separation. For this purpose, said sedimented phase was mixed with 20 ml of toluene and 10 ml of water and, after sedimentation, a supernatant enriched in oils, an intermediate aqueous phase and a sedimented residue comprising deoiled oil sand, were separated.

Approximately 5.5 g of oils equal to 49% of the oils present in the initial sample were recovered from said supernatant, after distillation of the toluene.

A total amount of 10.5 g of oils, equal to 94.3% of the oils present in the initial sample, was recovered together with 84.0 g of a solid residue having an oil content equal to 0.3% by weight which does not require further treatments.

EXAMPLE 6

A sample of 20 g of oil sand containing 10.8% by weight of oils (determined according to the method EPA 3540C as described above), was ground by means of a hammer mill and reduced to a particle size of less than 1 mm and divided into two equal aliquots.

A first aliquot (sample 7) was mixed, for 10 minutes, with a biphasic solution containing 2 g of toluene and 10 g of an aqueous solution of sodium hexametaphosphate at 8% by weight obtaining, by sedimentation, a supernatant comprising toluene saturated with water and enriched in oils, a sedimented residue impoverished in oils, and an intermediate aqueous phase saturated with toluene. Table 5 indicates the data relating to the supernatant and to the sedimented residue (i.e. sediment).

A second aliquot (sample 8) was mixed, for 10 minutes, with a biphasic solution containing 2 g of toluene and 10 g of water obtaining, by sedimentation, a supernatant comprising toluene saturated with water and enriched in oils, a sedimented residue impoverished in oils, and an intermediate aqueous phase saturated with toluene. Table 5 indicates the data relating to the supernatant and to the sedimented residue (i.e. sediment).

TABLE 5

| Sample | Phase | B (%) | C (%) | D (%) | E (%) |
|---|---|---|---|---|---|
| 7 | Supernatant | 54.9 | 17.9 | 8.94 | 90.8 |
| | Sediment | 45.1 | 2.2 | 1.0 | 9.2 |
| 8 | Supernatant | 60.2 | 15.8 | 9.48 | 87.5 |
| | Sediment | 39.8 | 3.4 | 1.35 | 12.5 |

B: densimetric distribution;
C: concentration of oils (determined according to the method EPA 3540C as described above);
D: distribution of oils (this is calculated by considering the oils at the inlet as 100 and calculating how they are distributed into the different granulometric fractions and the different phases);
E: distribution of oils (weight % with respect to the feed).

From Table 5 it can be deduced that the use of sodium hexametaphosphate allows a higher quantity of sedimented residue to be obtained (39.8% in the sample without sodium hexametaphosphate versus 45.1% in the sample with sodium hexametaphosphate) with a reduction in the oil content (from 3.4% by weight in the sample without sodium hexametaphosphate to 2.2% by weight in the sample with sodium hexametaphosphate).

EXAMPLE 7

A sample of 20 g of oil sand containing 10.8% by weight of oils (determined according to the method EPA 3540C as described above), was ground by means of a hammer mill and reduced to a particle size of less than 1 mm and divided into two equal aliquots.

A first aliquot (sample 9) was mixed, for 10 minutes, with a biphasic solution containing 2 g of toluene and 10 g of an aqueous solution of sodium hexametaphosphate at 8% by weight obtaining, by sedimentation, a supernatant comprising toluene saturated with water and enriched in oils, a sedimented residue impoverished in oils, and an intermediate aqueous phase saturated with toluene.

An amount of oils higher than 50% with respect to the oils contained in the initial sample was recovered from said supernatant, after distillation of the toluene, said oils having a low content of fine particles, i.e. particles having a particle size lower than or equal to 65 μm: the data obtained are indicated in Table 6.

A second aliquot (sample 10) was mixed, for 10 minutes, with a biphasic solution containing 2 g of toluene and 10 g of water obtaining, by sedimentation, a supernatant comprising toluene saturated with water and enriched in oils, a sedimented residue impoverished in oils, and an intermediate aqueous phase saturated with toluene.

An amount of oils higher than 50% with respect to the oils contained in the initial sample was recovered from said supernatant, after distillation of the toluene, but lower than the quantity recovered in sample 9, said oils having a higher content of fine particles, i.e. particles having a particle size lower than or equal to 65 μm, with respect to sample 9: the data obtained are indicated in Table 6.

TABLE 6

| Sample | F (%) | G (%) |
|---|---|---|
| 9 | 58.6 | 1.6 |
| 10 | 51.9 | 2.8 |

F: oils recovered with respect to the oils present in the feed (determined by considering the oils at the inlet as 100);
G: concentration of fine particles in the oils recovered (measured by subjecting the oils recovered to sedimentation and weighing the solid residue obtained).

From Table 6 it can be deduced that the use of sodium hexametaphosphate allows:

- a higher recovery of oils to be obtained in the supernatant (51.9% by weight in the sample without sodium hexametaphosphate versus 58.6% by weight in the sample with sodium hexametaphosphate);
- oils having a lower content of fine particles to be obtained (2.8% by weight in the sample without sodium hexametaphosphate versus 1.6% by weight in the sample with sodium hexametaphosphate)

The invention claimed is:

1. A process for the recovery of oils, the process comprising:

extracting a solid matrix by mixing the solid matrix with at least one organic solvent having a boiling point lower than or equal to 160° C., such that the extracting occurs at a temperature ranging from 5° C. to 40° C. and at atmospheric pressure (1 atm), to obtain a solid-liquid mixture;

separating the solid-liquid mixture to obtain a liquid phase, comprising oils and the at least one organic solvent, and a solid phase comprising the solid matrix;

adding an electrolyte to the liquid phase in a quantity ranging from 1% by weight with respect to a total weight of said liquid phase to a solubility limit of the electrolyte in the liquid phase; and recovering the at least one organic solvent from the liquid phase.

2. The process according to claim 1, wherein the extracting occurs at a temperature ranging from 15° C. to 30° C.

3. The process according to claim 1, wherein the solid matrix is selected from the group consisting of an oil sand, an oil rock and oil shale.

4. The process according to claim 1, wherein the at least one organic solvent has a density, measured at 20° C. and at atmospheric pressure (1 atm), lower than or equal to 1.5 g/cm$^3$.

5. The process according to claim 1, wherein the at least one organic solvent is selected from the group consisting of an ester, a ketone, an aliphatic hydrocarbon, and aromatic hydrocarbon, a refinery cut, and a mixture thereof.

6. The process according to claim 1, wherein a weight ratio between the solid matrix and the at least one organic solvent ranges from 1:0.5 to 1:10.

7. The process according to claim 1, wherein the mixing of the solid matrix with the at least one organic solvent is carried out for from 5 minutes to 60 minutes.

8. The process according to claim 1, wherein the solid matrix is extracted from 1 time to 10 times.

9. The process according to claim 1, wherein the recovery of the at least one organic solvent from the liquid phase occurs by distillation at a temperature ranging from 50° C. to 150° C. and at a pressure ranging from 0.01 atm to 1 atm.

10. A process for the recovery of oils, the process comprising:

grinding a solid matrix to obtain particles having a particle size lower than or equal to 5 mm;

separating the particles by densimetric separation, said densimetric separation comprising:

mixing the particles with water to obtain a first solid-liquid mixture; and separating the first solid-liquid mixture to obtain a supernatant comprising oils and a sedimented residue comprising a smaller proportion of the oils relative to a proportion of the oils in the supernatant;

extracting the supernatant by mixing the supernatant with at least one organic solvent having a boiling point lower than or equal to 160° C., such that the extracting occurs at a temperature ranging from 5° C. to 40° C. and at atmospheric pressure (1 atm), to obtain a second solid-liquid mixture;

separating the second solid-liquid mixture to obtain a liquid phase, comprising the oils and the at least one organic solvent, and a solid phase comprising a residue of the solid matrix; and recovering the at least one organic solvent from the liquid phase, wherein a weight ratio between the particles in the first solid-liquid mixture and the water ranges from 1:0.5 to 1:10.

11. The process according to claim 10, further comprising, before the densimetric separation:

separating the particles by granulometric separation to obtain fractions of particles having different particle sizes, said fractions being subsequently separated by the densimetric separation.

12. The process according to claim 10, wherein the first solid-liquid mixture is obtained by mixing the particles with water and with at least one deflocculating agent.

13. The process according to claim 12, wherein said deflocculating agent is present in such a quantity as to obtain a concentration of the deflocculating agent in the first solid-liquid mixture ranging from 0.8% by weight to 15% by weight with respect to a total weight of the water present in the first solid-liquid mixture.

14. The process according to claim 12, wherein the first solid-liquid mixture is obtained by mixing the particles with water and with at least one deflocculating agent selected from the group consisting of a polyphosphate, a hydroxide, a carbonate, a halogenated compound, a lignosulfonate and a mixture thereof.

15. A process for the recovery of oils, the process comprising:

extracting a solid matrix by mixing the solid matrix with at least one organic solvent having a boiling point lower than or equal to 160° C., such that the extracting occurs at a temperature ranging from 5° C. to 40° C. and at atmospheric pressure (1 atm), to obtain a solid-liquid mixture;

separating the solid-liquid mixture to obtain a liquid phase, comprising oils and the at least one organic solvent, and a solid phase comprising the solid matrix;

recovering the at least one organic solvent from the liquid phase; and subjecting the solid phase to thermal desorption, at a temperature ranging from 50° C. to 150° C.

16. The process according to claim 15, wherein the extracting occurs at a temperature ranging from 15° C. to 30° C.

17. The process according to claim 15, wherein the solid matrix is selected from the group consisting of an oil sand, an oil rock and oil shale.

18. The process according to claim 15, wherein the at least one organic solvent has a density, measured at 20° C. and at atmospheric pressure (1 atm), lower than or equal to 1.5 $g/cm^3$.

19. The process according to claim 15, wherein the at least one organic solvent is selected from the group consisting of an ester, a ketone, an aliphatic hydrocarbon, and aromatic hydrocarbon, a refinery cut, and a mixture thereof.

20. The process according to claim 15, wherein a weight ratio between the solid matrix and the at least one organic solvent ranges from 1:0.5 to 1:10.

21. The process according to claim 15, wherein the mixing of the solid matrix with the at least one organic solvent is carried out for from 5 minutes to 60 minutes.

22. The process according to claim 15, wherein the solid matrix is extracted from 1 time to 10 times.

23. The process according to claim 15, wherein the recovery of the at least one organic solvent from the liquid phase occurs by distillation at a temperature ranging from 50° C. to 150° C. and at a pressure ranging from 0.01 atm to 1 atm.

* * * * *